US008097845B2

(12) United States Patent
Roach et al.

(10) Patent No.: US 8,097,845 B2
(45) Date of Patent: Jan. 17, 2012

(54) FOCUSED ANALYTE SPRAY EMISSION APPARATUS AND PROCESS FOR MASS SPECTROMETRIC ANALYSIS

(75) Inventors: Patrick J. Roach, Kennewick, WA (US); Julia Laskin, Richland, WA (US); Alexander Laskin, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 154 days.

(21) Appl. No.: 12/722,257

(22) Filed: Mar. 11, 2010

(65) Prior Publication Data

US 2011/0220784 A1 Sep. 15, 2011

(51) Int. Cl.
*H01J 49/04* (2006.01)

(52) U.S. Cl. ..... 250/288

(58) Field of Classification Search ..... 250/288
See application file for complete search history.

(56) References Cited

U.S. PATENT DOCUMENTS

| | | | | |
|---|---|---|---|---|
| 4,999,493 | A | 3/1991 | Allen et al. | |
| 6,803,566 | B2 | 10/2004 | Van Berkel | |
| 7,295,026 | B2 | 11/2007 | Van Berkel et al. | |
| 7,335,897 | B2 | 2/2008 | Takats et al. | |
| 7,394,065 | B2 | 7/2008 | Grimm, II et al. | |
| 7,462,824 | B2 * | 12/2008 | Wang | 250/288 |
| 2003/0193020 | A1 | 10/2003 | Van Berkel | |
| 2008/0156985 | A1 | 7/2008 | Venter et al. | |
| 2008/0272294 | A1 | 11/2008 | Kovtoun | |

FOREIGN PATENT DOCUMENTS

| | | | |
|---|---|---|---|
| WO | 2010101656 | A1 | 9/2010 |
| WO | 2010114976 | A1 | 10/2010 |

OTHER PUBLICATIONS

PCT Notification of transmittal of the International Search Report and the Written Opinion of the International Searching Authority for International Application No. PCT/US2011/020302, International Filing Date Jan. 6, 2011.

Roach, Patrick J., et al., Molecular Characterization of Organic Aerosols Using Nanospray-Desorption/Electrospray Ionization-Mass Spectromotry +, Analytical Chemistry, vol. 82, No. 19, Jul. 28, 2010, pp. 7979-7986.

Laskin, A. et al., Molecular Characterization of Organic Aerosol, Retrieved from the Internet: URL:http://asr.science.energy.gov/meetings/fall-working-groups/2010/presentations/Laskin.ASR_ALCWGI.pdf, Oct. 12, 2010.

* cited by examiner

*Primary Examiner* — Kiet T Nguyen
(74) *Attorney, Agent, or Firm* — James D. Matheson

(57) ABSTRACT

An apparatus and process are disclosed that deliver an analyte deposited on a substrate to a mass spectrometer that provides for trace analysis of complex organic analytes. Analytes are probed using a small droplet of solvent that is formed at the junction between two capillaries. A supply capillary maintains the droplet of solvent on the substrate; a collection capillary collects analyte desorbed from the surface and emits analyte ions as a focused spray to the inlet of a mass spectrometer for analysis. The invention enables efficient separation of desorption and ionization events, providing enhanced control over transport and ionization of the analyte.

31 Claims, 7 Drawing Sheets

FOCUSED ANALYTE SPRAY EMISSION APPARATUS AND PROCESS FOR MASS SPECTROMETRIC ANALYSIS

STATEMENT REGARDING RIGHTS TO INVENTION MADE UNDER FEDERALLY-SPONSORED RESEARCH AND DEVELOPMENT

This invention was made with Government support under Contract DE-AC05-76RLO1830 awarded by the U.S. Department of Energy. The Government has certain rights in the invention.

FIELD OF THE INVENTION

The present invention relates generally to electrospray ionization systems and processes. More particularly, the invention relates to a focused analyte spray emission apparatus and process for ionization of analytes desorbed from substrates for mass spectrometric analysis.

BACKGROUND OF THE INVENTION

Desorption Electrospray Ionization Mass Spectrometry (DESI-MS) is an ambient ionization technique that allows chemical analytes to be sampled from surfaces without special sample preparation. DESI-MS has been used for high throughput analysis of analytes on substrates, imaging, and online liquid sampling. FIG. 1 shows a conventional DESI-MS system. In the figure, solvent 2 is electrosprayed from the tip of capillary 4 of an electrosonic spray ionization source (not shown) and directed towards surface 14, forming charged solvent droplets 20 that are accelerated with the aid of nebulizer gas 10 that is passed through an outer capillary 8 of the electrosonic spray ionization source. Charged solvent (primary) droplets 20 released from capillary 4 form a liquid film 16 on surface 14 that eject secondary fluid droplets 22 containing analyte 18 desorbed from surface 14. Analyte 18 on surface 14 is removed from surface 14 by heterogeneous charge-transfer or droplet pick-up. Secondary charged solvent droplets 22 containing analyte ions 18 ejected from the surface are subsequently introduced at atmospheric pressure through inlet 24 of mass spectrometer 26 for analysis. Secondary droplets 22 result primarily from momentum transfer as primary solvent droplets 20 accelerated from capillary 4 by nebulizer gas 10 contact liquid film 16 on surface 14. As a result, secondary droplets 22 containing analyte ions 18 sampled from surface 14 are "splashed" towards inlet 24 of mass spectrometer 26 and surrounding areas. Splashing of droplets 22 containing analyte ions 18 is caused by collision between primary solvent droplets 20 and neutral gas 10 molecules in incoming gas jet stream 12 with liquid film 16 on surface 14, which results in transport of analyte 18 from surface 14. The splashing effect is undesirable in many applications, including, e.g., chemical imaging, because it can result in decreased detection efficiency, reduced detection limits, material transport on the surface and material loss, e.g., if charged solvent droplets containing analyte first encounter a counter electrode that is not the inlet of the mass spectrometer. Accordingly, new desorption devices and process are needed that minimize "splashing" effects at the surface, thereby maximizing analyte collection efficiency from the surface for suitable imaging and analysis of complex analytes.

The present invention provides a new apparatus and process for meeting these needs. Additional advantages and novel features of the present invention will be set forth as follows and will be readily apparent from the descriptions and demonstrations set forth herein. Accordingly, the following descriptions of the present invention should be seen as illustrative of the invention and not as limiting in any way.

SUMMARY OF THE INVENTION

The invention is an apparatus and process for delivering an analyte, deposited on a substrate, as a focused spray to a mass analyzer instrument, providing trace analysis of complex analytes. In a preferred embodiment, the invention serves as an ambient surface ionization source for direct probing of an analyte on a sampling surface. The analyte is desorbed from the surface and supplied in a focused spray to a mass analyzer for analysis. A supply capillary delivers solvent at a preselected flow rate to a sampling surface that includes an analyte deposited on the surface. The solvent is delivered to the sampling surface in the absence of a nebulizing gas. The supply capillary delivers the solvent so as to be in continuous and simultaneous fluid contact with the collection capillary and the sampling surface. The supply capillary delivers solvent to the sampling surface at a flow rate that maintains the selected size of the contact area on the sampling surface. In one embodiment, flow rate is less than or equal to about 0.4 μL/min. In other embodiments, flow rate is between about 0.1 μL/min and about 2.0 μL/min. In various embodiments, contact area between the solvent and the sampling surface has a diameter between about 50 μm and about 6,000 μm. In other embodiments, contact area between the solvent and the sampling surface has a diameter of a size less than or equal to about 50 μm. In other embodiments, contact area between the solvent and the sampling surface has a diameter greater than or equal to about 6,000 μm. In yet other embodiments, contact area between the solvent and sampling surface has a diameter of a size less than or equal to about 6000 μm. In one embodiment, solvent can be delivered to the sampling surface by pneumatic flow. A collection capillary includes a collection end configured to aspirate solvent from the contact area containing analyte desorbed from the sampling surface and transports the analyte-containing solvent within the collection capillary. The collection capillary also includes an emission end that emits a focused spray of analyte ions at a preselected potential into an inlet of a mass analyzer positioned a preselected distance from the emission end. The collection end of the collection capillary has a point size (diameter) preferably less than or equal to about 360 μm. In one embodiment, the collection end of the collection capillary has a point size (diameter) between about 3 μm and 360 μm. The emission end of the collection capillary has a point size (diameter) preferably less than or equal to about 360 μm. The emission end of the collection capillary is positioned a preselected distance from the inlet of the mass analyzer. In particular, distances are less than or equal to about 15 mm. More particularly, distance is less than or equal to about 1 mm. Analyte ions are delivered as a focused spray to the inlet of the mass analyzer at various preselected potentials less than or equal to about 8,000 volts. In one embodiment, potentials are between about 500 volts and 8,000 volts. Solvent delivered from the supply capillary to the sampling surface is positioned so as to be in electrical contact with two terminals that establishes a liquid circuit at the preselected potential that defines the spray voltage. In one embodiment, the two terminals are the sampling surface and the inlet of the mass analyzer, respectively. In another embodiment, the two terminals are positioned in-line in the supply capillary and the inlet of the mass analyzer, respectively. The sampling surface can include three-dimensional surfaces and structures including, but not limited to, e.g., hills, valleys, pores, and other three-dimensional structures. The invention is preferably operated at atmospheric pressure, but can further include an enclosure that is evacuated or pressurized to allow for operation at evacuated (reduced) or elevated pressures. The emission step includes emitting the analyte-containing solvent in an electric field as a focused spray of self-aspirated analyte ions. Chemicals that react with the analyte can be included with the solvent to monitor, screen, or employ analyte and surface reactivity, including, e.g., catalysis. The electric field at the preselected potential can be biased positively or negatively to generate positive or negatively charged analyte ions. The invention provides a limit of detection and sensitivity that is at least one order of magnitude better than a lowest limit of detection or sensitivity for conventional desorption electrospray ionization methods. Flow of analyte-containing solvent in the collection capillary is preferably a self-aspirating fluid flow. The aspirating step includes contacting the solvent containing the analyte desorbed from the surface with the collection end of the collection capillary or otherwise immersing the collection end into the solvent. In various embodiments, contact time between the collection capillary and the analyte-containing solvent is below about 2 hours. In one embodiment, the contact time is a time below about 1 second. Analyte on the surface can be probed at, below, or above atmospheric pressure as described further herein. The invention allows analytes and other chemicals located on a user-specified contact or sampling area of a surface to be sampled. Both the position and size of the contact area can be directly controlled by the operator. Boundaries of the contact area are discrete and there is negligible sample transfer between a sampled area and a non-sampled area. Sampling areas can be made much smaller than those probed using conventional desorption electrospray ionization techniques. The invention allows for mass spectrometric chemical imaging and provides greater resolution than is provided by conventional desorption electrospray ionization techniques that probe a surface. The invention can further include an adjustable stage for mounting substrates that allows motion and tilting for positioning the sampling surface relative to the supply capillary and the collection capillary, or otherwise fractional and/or incremental adjustments along the X, Y, and Z axes. Heating can be used to desorb analyte from the sampling surface. The sampling surface can be a conducting surface, a non-conducting surface, or semi-conductive surface. For example, the heater can be positioned in electrical contact with the supporting stage so as to maintain the temperature of the sampling surface at a controlled value. The invention can also be used as a component of an MS/MS process or instrument system. The invention can further include illumination, magnification, and/or microscope devices, and video camera components to observe locations on the sampling surface where, e.g., analyte molecules are probed, and for viewing the contact between the collection capillary and the receiving substrate. The detection limit sensitivity resulting from use of the invention may be evaluated using an internal mass standard. The invention allows an operator to pre-separate in the collection capillary one analyte from another analyte originating from the same sample desorbed from the sampling surface. In some cases, the analyte will be a salt-based analyte. The sample stage where the analyte sample is mounted is adjustable and rotable to allow for probing of the analyte or sampling spot at different locations on the sampling surface. Solvents used in conjunction with the invention include, but are not limited to, e.g., water, alcohols, toluene, hexane, acetonitrile, dichloromethane, dichloroethane, tetrahydrofuran, nitromethane, and other polar and non-polar solvents, including combinations of these solvents. Solvents further include constituents including, e.g., salts, buffers, acids, bases, including combinations of these constituents. The invention is also suited to analysis of inorganic, organic, and biological materials.

The purpose of the foregoing abstract is to enable the United States Patent and Trademark Office and the public generally, especially scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Various advantages and novel features of the present invention are described herein and will become further readily apparent to those skilled in this art from the following detailed description. In the preceding and following descriptions the preferred embodiment of the invention is shown and described by way of illustration of the best mode contemplated for carrying out the invention. As will be realized, the invention is capable of modification in various respects without departing from the invention. Accordingly, the drawings and description of the preferred embodiment set forth hereafter are to be regarded as illustrative in nature, and not as restrictive.

A more complete appreciation of the invention will be readily obtained by reference to the following description of the accompanying drawings in which like numerals in different figures represent the same structures or elements.

DETAILED DESCRIPTION

An apparatus and process are described herein that provide enhanced analytical capabilities including significant improvement in the limits of detection, signal stability, and imaging applications compared to traditional desorption electrospray ionization. Basics for construction and operation are also detailed. The following description includes the preferred best mode of one embodiment of the present invention. It will be clear from this description of the invention that the invention is not limited to these illustrated embodiments but that the invention also includes a variety of modifications and embodiments thereto. Therefore the present description should be seen as illustrative and not limiting. While the invention is susceptible of various modifications and alternative constructions, it should be understood that there is no intention to limit the invention to the specific form disclosed, but, on the contrary, the invention covers all modifications, alternative constructions, and equivalents falling within the spirit and scope of the invention as defined in the claims.

Figure 1:
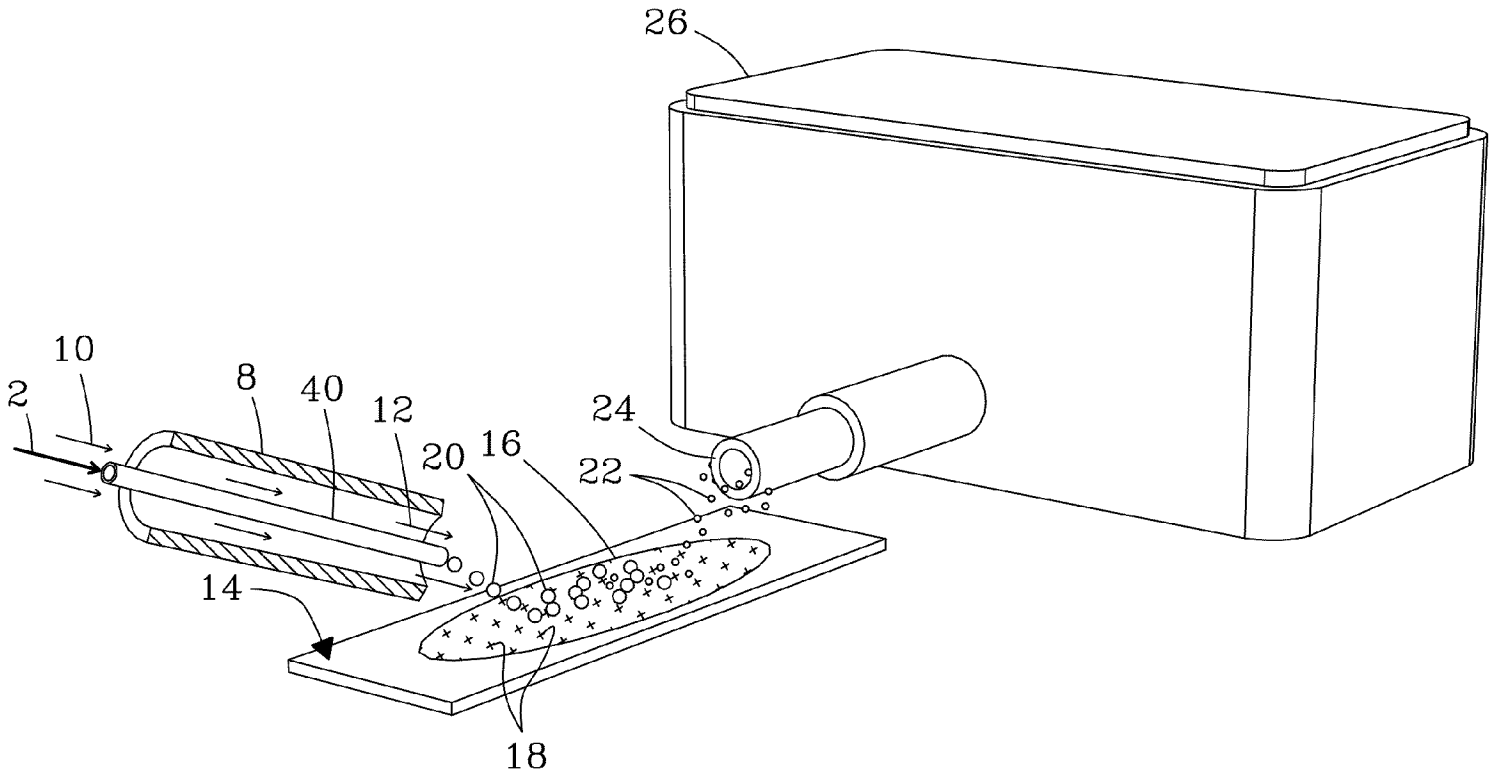
Fig. 1 Prior Art
FIG. 1 (Prior Art) shows a conventional DESI-MS system.
Figure 2:
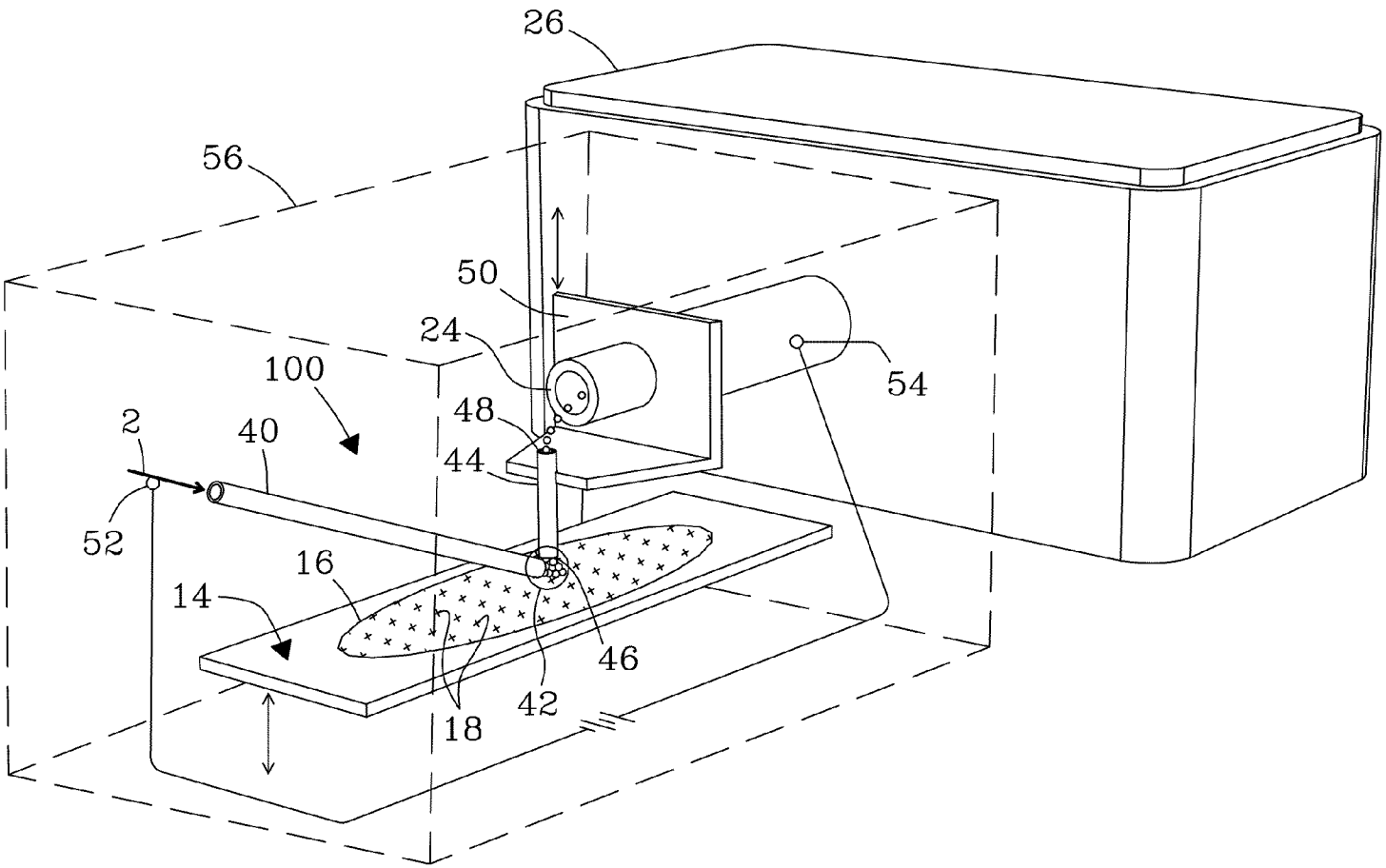
FIG. 2 shows a focused analyte spray apparatus for delivery of complex analytes collected from a sampling surface, according to one embodiment of the invention.

FIG. 2 shows a focused analyte spray apparatus 100 (source 100) for delivery of an analyte 18 to a mass spectrometer 26. Apparatus 100 includes a supply capillary 40 that delivers a preselected quantity of solvent 2 at a preselected flow rate to a sampling surface 14, which rate is not limited. Sampling surface 14 includes an analyte 18 deposited thereon that defines an analyte film 16 on sampling surface 14. Solvent 2 is in fluid contact with supply capillary 40 and sampling surface 14. Contact between solvent 2 and surface 14 at the selected flow rate defines a contact (sampling) area 42 on surface 14. Source 100 further includes a collection capillary 44 of a self-aspiration design that includes a collection end 46 that collects solvent containing analyte desorbed from surface 14 from contact area 42, and an emission end 48 that generates and provides a focused spray of analyte ions at a preselected potential to the inlet 24 of a mass analyzer 26 positioned in close proximity to emission end 48. Solvent 2 is delivered to sampling surface 14 preferably at a rate that equals the rate of aspiration provided by collection capillary 44 that maintains a discrete contact area 42 of a preselected size between solvent 2 and surface 14. The contact area 42 defined by solvent 2 on sampling surface 14 can be of various discrete, non-limiting forms. For example, depending on flow rate, contact area 42 of the solvent 2 may be in the form of a discrete droplet. The term "droplet" as used herein refers to a protrusion that extends from supply capillary 40 when supplied at a flow rate greater than the self-aspiration rate of collection capillary 44, which depends on the dimensions of the supply capillary 40 and collection capillary 44, respectively. A preferred contact area is less than or equal to about 300 μm, but is not limited thereto, as described herein. The self-aspiration mechanism provides for operation at low selected solvent flow rates without need for nebulizer gas. Flow rates from supply capillary 40 are preferably less than or equal to about 0.6 μL/min, but are not limited thereto, as described herein. Analyte 18 present in analyte film 16 on surface 14 is rapidly desorbed into solvent 2 within contact area 42. When solvent 2 from contact area 42 fills collection capillary 44, a liquid circuit is established. The liquid circuit establishes an electric field between two selected terminals 52 and 54 or charge locations 52 and 54 positioned, e.g. a) between solvent 2 and inlet 24 of mass analyzer 26, b) between sampling surface 14 and net 24 of mass analyzer 26, or c) between supply capillary 40 and inlet 24 of mass analyzer 26. The potential difference between the two selected locations 52 and 54 is preferably less than or equal to about 8,000 volts. In yet other embodiments, the selected potential is between about 2 kV to about 3.5 kV, but potential is not intended to be limited to these exemplary voltages. The "self-aspiration potential" is the electrostatic potential established between inlet 24 of mass analyzer 26 and collection end (tip) 46 of collection capillary 44. Emission end 48 of collection capillary 44 is affixed using a custom-built holder 50 to allow positioning in close proximity to inlet 24 of mass spectrometer 26. Distances are preferably selected in the range below about 15 mm, but are not limited thereto. In particular, distance can be between about 2 mm and about 3 mm. In other configurations, distance is less than or equal to about 1 mm. The close proximity of emission end 48 to inlet 24 at the selected electrical potential affects the rate of aspiration (uptake) of solvent containing analyte 18 desorbed from surface 14, which is important for optimizing signal intensity. The high potential applied to collection capillary 44 provides a spray of focused analyte ions 18 from emission end 48 to inlet 24 of mass analyzer 26. Source 100 operates in both positive and negative ion mode; analyte ions 18 can be selectively emitted as either positive or negative ions. For example, in positive ion mode, source 100 creates intact, protonated parent (precursor) ions and other closed-shell ions. Voltage across the liquid circuit and composition of the selected solvent mixture are important parameters for operation of the invention. Continuous desorption of analyte 18 from sampling surface 14 and collection into collection capillary 44 provides a continuous detection signal in mass analyzer 26. The detection signal is stable and easily maintained as long as the liquid circuit is maintained and analyte 18 is present on sampling surface 14. In some embodiments, the invention includes an enclosure 56 that can be evacuated or pressurized to allow operation at evacuated (reduced) or elevated pressures. No limitations are intended. All equipment and instrument modifications as will be envisioned or implemented by those of ordinary skill in the art in view of this disclosure are within the scope of the invention.

The present invention is distinguished from conventional desorption electrospray ionization approaches in at least five critical ways. First, the invention employs no nebulizer gas, which provides improved detection limits as well as enhanced control of sample transfer into MS 26. Second, sample diffusion within contact area 42 on sampling surface 14 is minimized. Third, size of contact (sampling) area 42 is minimized. Fourth, solvent 2 remains within the preselected sample contact area 42, minimizing the potential for analyte diffusion or transport on or across sampling surface 14. The invention thus provides signal stability, e.g., for imaging applications. Fifth, analyte ions 18 desorbed from sampling surface 14 are delivered as a focused spray from emission end 48 of collection capillary 44, which eliminates "splashing" associated with conventional desorption electrospray ionization sources. This splashing mechanism makes conventional desorption electrospray ionization sources unsuitable for imaging of surface-deposited analytes. The present invention is further distinguished from conventional liquid micro-junction surface sampling probe/electrospray ionization mass spectrometry (LMJ-SSP ESI-MS) approaches in that the capillary arrangement achieves smaller spot sizes and eliminates use of nebulizer gas. The present invention is also distinguished from conventional nano-spray approaches in that analyte is sampled from the sampling surface without prior sample preparation, e.g., without prior extraction of analyte into solvent. The present invention is further distinguished from conventional scanning probe mass spectrometry (SPMS) approaches in that aspects of collection, desorption, and ionization are separated from the supply of solvent provided to the sampling surface. This separation permits an operator to probe analytes collected from both solid and liquid surfaces, not just liquid surfaces as in conventional SPMS approaches.

Solvents and Analytes

The present invention uses solvents known in the liquid chromatography and mass spectrometry arts including, but not limited to, e.g., polar solvents and non-polar solvents. Polar solvents include, e.g., water, alcohols (e.g., methanol), and acetonitrile. Non-polar solvents include, e.g., toluene and hexane. Solvents used in conjunction with the invention can further include salts, acids, bases, buffers, and other constituents and reagents as will be understood by the person of ordinary skill in the mass spectrometry art. The present invention is also suitable for analyzing various analytes of interest. Analytes include, but are not limited to, e.g., peptides, peptidomimetics, proteins, polymers, food materials, drugs, metabolites, drugs, pharmaceuticals, toxins, chemical reagents, explosives, particulate matter, abuse substances, and biological materials including, e.g., bacteria, cells, tissues, and other analytes. Analytes are limited only by the extent of solubility in a selected solvent. The invention provides a limit of detection or sensitivity for analytes at least an order of magnitude better than conventional desorption electrospray ionization.

Surfaces

Surfaces include, but are not limited to, e.g., conducting surfaces, non-conducting surfaces, and semi-conductive surfaces. Surfaces can also include two-dimensional and three-dimensional surfaces. Three-dimensional surfaces include, e.g., hills, valleys, pores, and other three-dimensional surfaces including, e.g., fibers and hairs. Substrates upon which surfaces are placed or occur naturally are also not limited.

Chemical Imaging

Chemical imaging is a technique in which mass spectra from various sample probes collected for, and over, a preselected sampling area. For example, a first analyte sample is collected in a first surface location and a first mass spectrum is collected. Then, the sampling probe (collection capillary) is moved to a different location and a second analyte sample is collected at a second surface location within the sampling area, where another spectrum is collected. The process is repeated until a preselected, and statistically significant, sampling frequency is obtained. Signal intensities from the collection of mass spectra are plotted as a function of position on the sampling surface, allowing an operator to generate a spatial profile or map of the different chemical species identified within the sampling area (i.e., a sample). These data can be used to create a profile for, or probe of, a tissue, a single cell, or be used as a fingerprint for the selected sample. Two-dimensional and three-dimensional spatial maps can be generated in conjunction with data obtained along two or more axial locations or orientations. No limitations are intended by the exemplary description.

Exemplary Operation Steps

Figure 3:
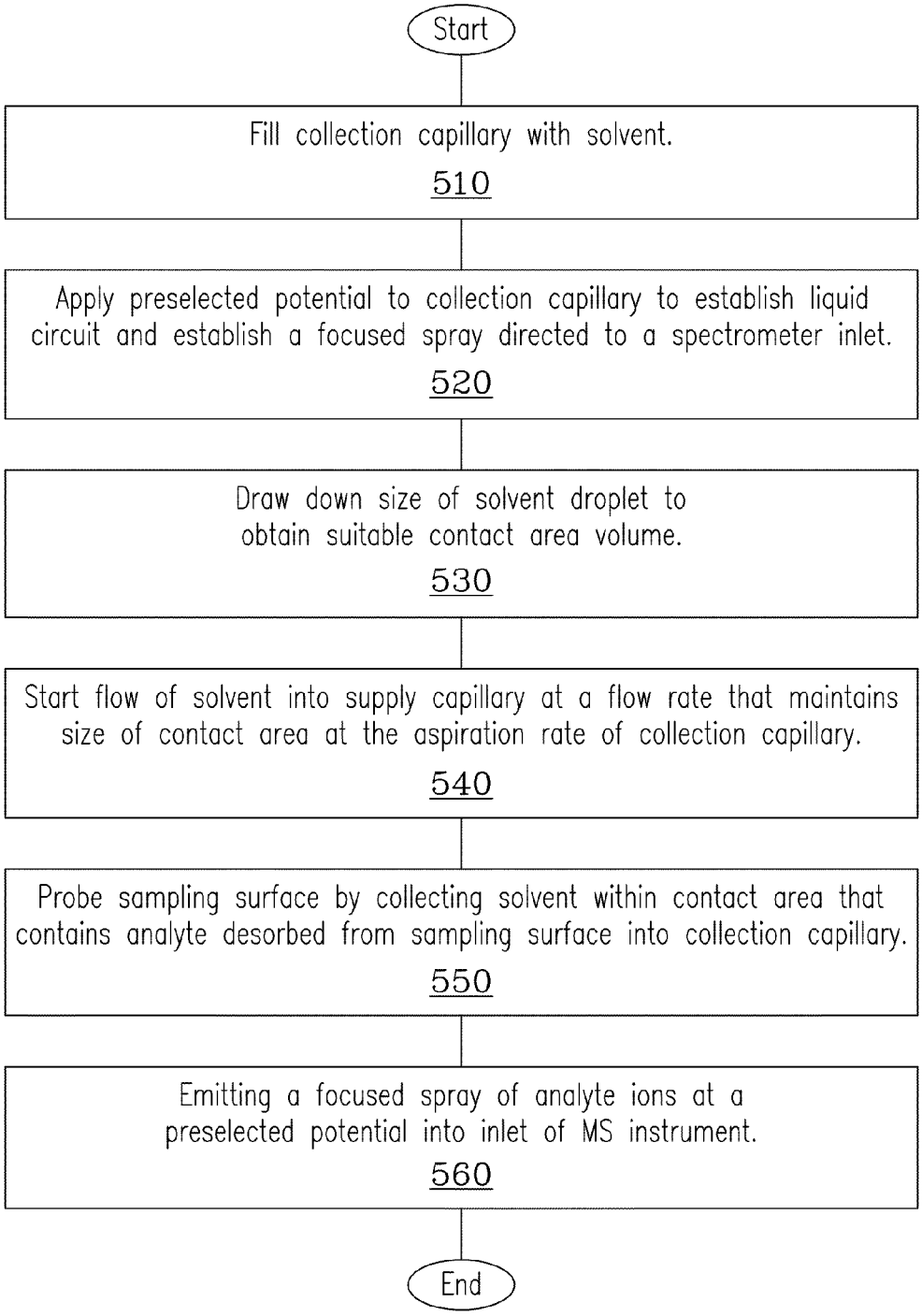
FIG. 3 shows exemplary process steps for probing an analyte on a sampling surface in conjunction with the invention.

FIG. 3 shows exemplary process steps for probing (sampling) an analyte on a surface in conjunction with the invention. {START}. In a first step {step 510} away from the sampling surface 14, collection capillary 44 is primed for operation by contacting a droplet of solvent 2 formed at the end of supply capillary 40 with the collection end 46 of the collection capillary 44, which fills the collection capillary 44 with solvent 2. The droplet is formed at the delivery end (tip) of supply capillary 40 by purging an excess amount of solvent 2 from supply capillary 40, e.g., in conjunction with a syringe pump. In another step {step 520}, a preselected and suitable potential (from a preselected voltage) is applied to collection capillary 44, which establishes a liquid circuit between two selected terminals described herein (e.g., between sampling surface 14 and mass spectrometer inlet 24, or between supply capillary 40 and mass spectrometer inlet 24) and initiates a spray of solvent 2 from the emission end 48 of collection capillary 44 directed at the mass spectrometer inlet 24. If the potential is applied before collection capillary 44 is filled, a phenomenon called "electro-wetting" prevents capillary forces from filling collection capillary 44, preventing formation of the required circuit with mass spectrometer inlet 24. Thus, the solvent droplet is attracted to an alternate ground. In another step {step 530}, size of the solvent droplet at the tip of supply capillary 40 is allowed to be drawn down by the spray coming from the emission end 48 of collection capillary 44 until the droplet size has a preselected volume suitable for establishing the desired contact area (e.g., 0.5 uL) when placed in contact with surface 14. In another step {step 540}, when the solvent droplet is of a desired size, flow of solvent 2 into supply capillary 40 is initiated at a flow rate that maintains the selected size of contact area 42 (e.g., at the self-aspiration rate into collection capillary 44). The solvent droplet can now be used to sample and analyze (probe) the analyte on sampling surface 14. The surface 14 includes an analyte 18 of a sufficient thickness that defines a surface film 16 to be probed, which thickness is not intended to be limited. In another step {step 550}, analyte 18 desorbed from sampling surface 14 into solvent 2 within contact area 42 is collected by self-aspiration into collection capillary 44 upon contact with the collection end 46 of collection capillary 44. In another step {560}, analyte 18 in collection capillary 44 is ionized at the preselected potential and released from the emission end 48 of collection capillary 44 as a focused spray of analyte ions 18, which is directed into inlet 24 of mass analyzer 26. In typical operation, the pressure of source 100 is at or near atmospheric pressure. But, the invention can operate at pressures above atmospheric pressure, or at reduced pressure when source 100 is enclosed within a pressurized or an evacuated enclosure 56, respectively. Operating temperatures are typically between about ~20° C. and ~150° C., but are not intended to be limited. For example, elevated temperatures can be applied to either the sample stage or enclosure to assist desorption of analytes 18 from sampling surface 14 into the solvent 2 within the contact area 42, thereby facilitating collection by collection capillary 44. {END}.

Exemplary Sample Analysis Experiments

Figure 4:
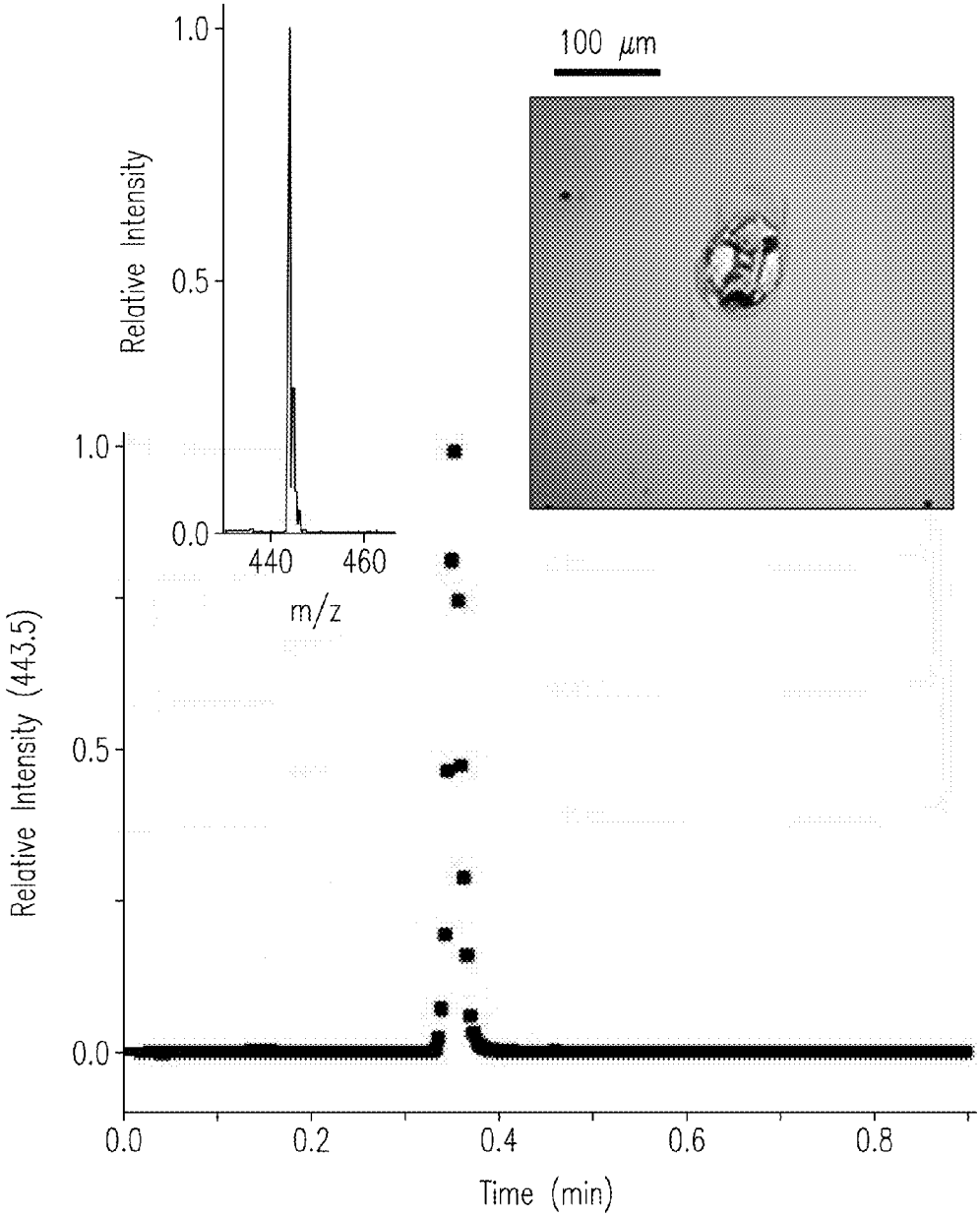
FIG. 4 shows an analysis of a rhodamine film on a glass substrate at a probe contact time of 1 second using an embodiment of the invention.

Analyses of various surface films placed on a glass slides were performed, as described hereafter. The surface films were used to characterize the contact areas on the sampling surface sampled as a function of contact time between the solvent and the sampling surface. FIG. 4 shows an analysis using the invention of a rhodamine film collected from a glass surface at a probe (capillary) contact time of less than one second. In the figure, a selected ion chromatogram (SIC) (left inset) of the mass (left-most graph) peak (m/z) at 443.5 for rhodamine (analyte) and an optical image of the resulting sample spot on the rhodamine film (right outset) are shown. The mass spectrum was averaged from the SIC chromatogram peak (inset left) and optical image of resulting perturbation (right), with a signal-to-noise ratio (S/N) of 330. The optical image of the resulting sampling spot in the rhodamine film is less than 100 μm in diameter. A chip at the middle of the spot was created when contact with the probe capillary abraded the surface. The one second "tapping" interaction resulted in a sharp Gaussian shaped SIC peak with a full width half max (FWHM) value of 0.8 sec.

Figure 5:
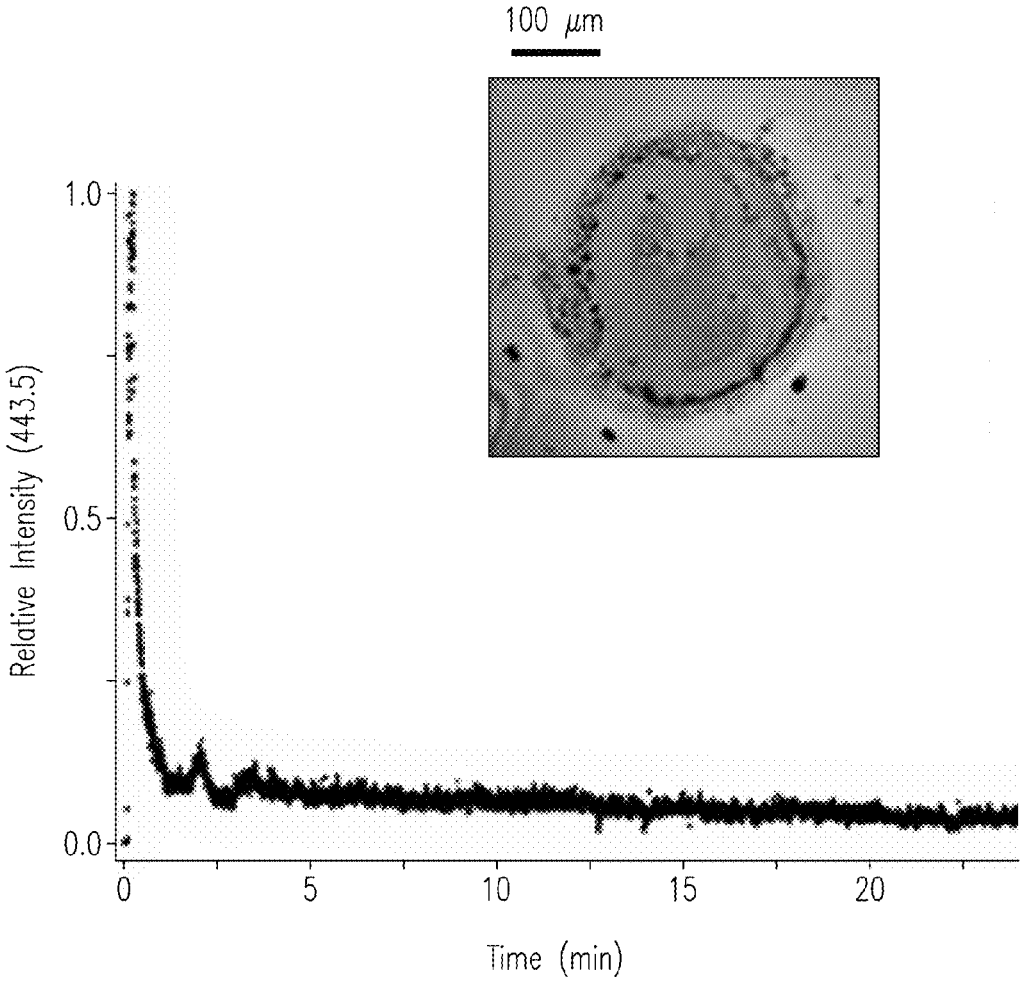
FIG. 5 shows an analysis of a rhodamine film on a glass substrate at a probe contact time of 25 minutes using an embodiment of the invention.

FIG. 5 shows an analysis using the invention of a rhodamine film collected from a glass surface at a probe (capillary) contact time of 25 minutes. In the figure, the SIC (left inset) of the mass (left-most graph) peak (m/z) at 443.5 for rhodamine (analyte) and an optical image of the resulting sample spot on the rhodamine film (right outset) are shown. Again, the mass spectrum was averaged from the SIC chromatogram peak (inset left) and optical image of resulting perturbation (right). The 25 minute "extended" interaction resulted in a SIC that increased to maximum intensity by 7 seconds and fell to half maximum after 16 seconds. A slowly decaying shoulder in the SIC is present that continued throughout the experiment. A mass spectrum averaged over one second of acquisition time at the maximum of the SIC has S/N of 500, and a mass spectrum obtained at the 20th minute has S/N of 20. The optical image of the resulting sampling spot in the rhodamine film is 300 μm in diameter. The initial intensity spike is attributed to dissolution of the rhodamine film over the entire droplet contact area and the extended shoulder to dissolution at the circumference as the droplet slowly spreads over the course of the experiment.

Figure 6:
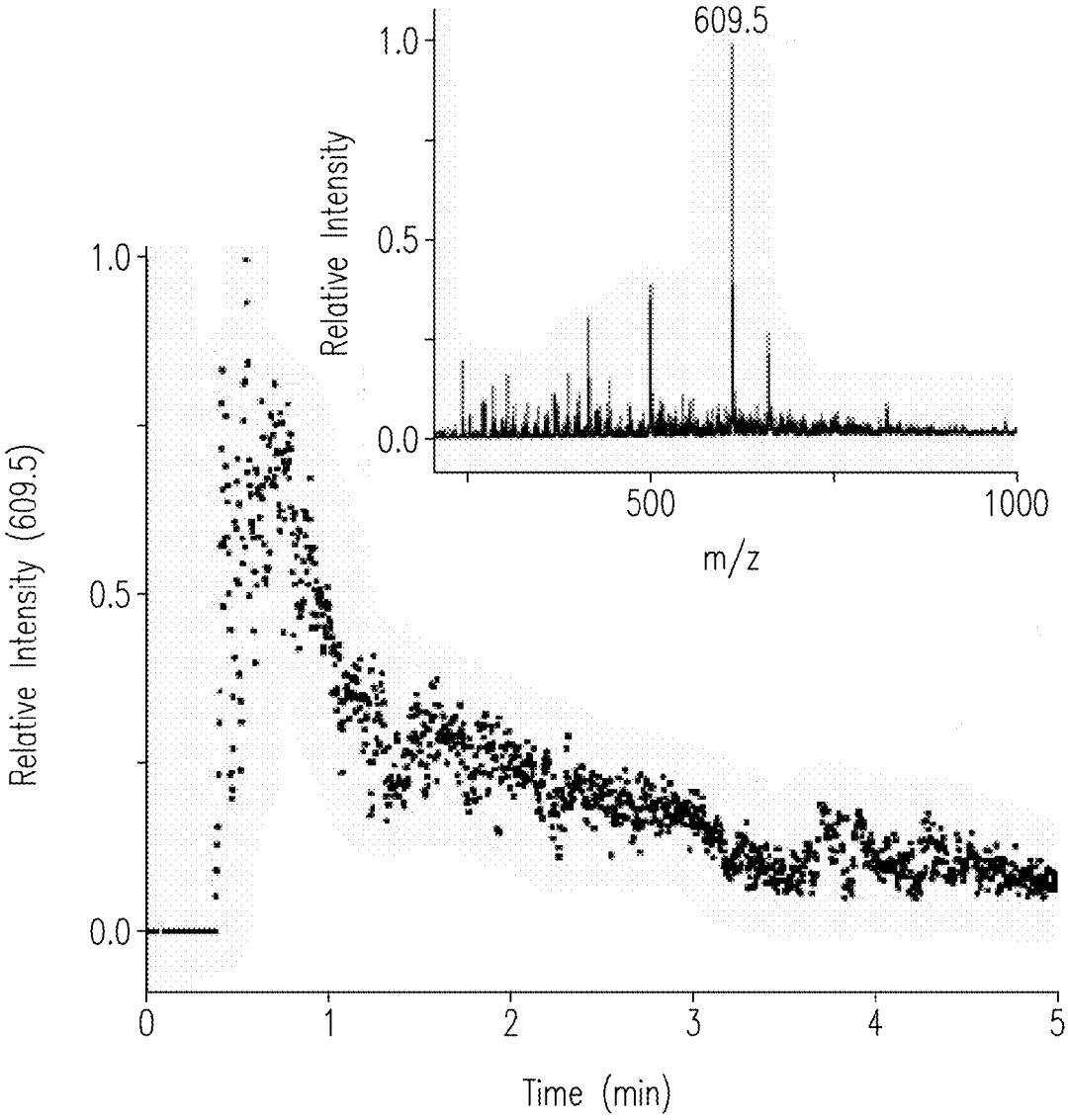
FIG. 6 shows an analysis of reserpine collected from an analyte film using an embodiment of the invention.

FIG. 6 shows an analysis by the invention of an analyte film containing 10 fmol (0.7 pg) of reserpine placed on an Omnislide® substrate (Prosolia Inc., Indianapolis, Ind., USA). The substrate further included polytetrafluoroethylene (PTFE). In the figure, the major plot shows the SIC of a mass peak of reserpine positioned at an (m/z) value of 609.5. The inset plot shows a single mass spectrum scan taken at a maximum intensity. The SIC of the protonated reserpine cation peak at m/z 609.5 with a single mass spectrum scan was taken at a maximum intensity. The ion signal increased to a maximum in 10 seconds and decayed to half maximum in 34 seconds. The S/N value from analysis of the 0.7 ng of reserpine was 20, which decreased to a S/N of 5 after only about 2 minutes. Results obtained with the invention represent a significant improvement in the limit of detection compared to conventional DESI analysis that gave a S/N ratio of 5 from a 10 ng sample of reserpine on a similar substrate. These data show the enhanced limits of detection achieved with the invention. The improvement in detection results is attributed to an increase in sampling efficiency achieved by minimization of splashing losses.

Figure 7:
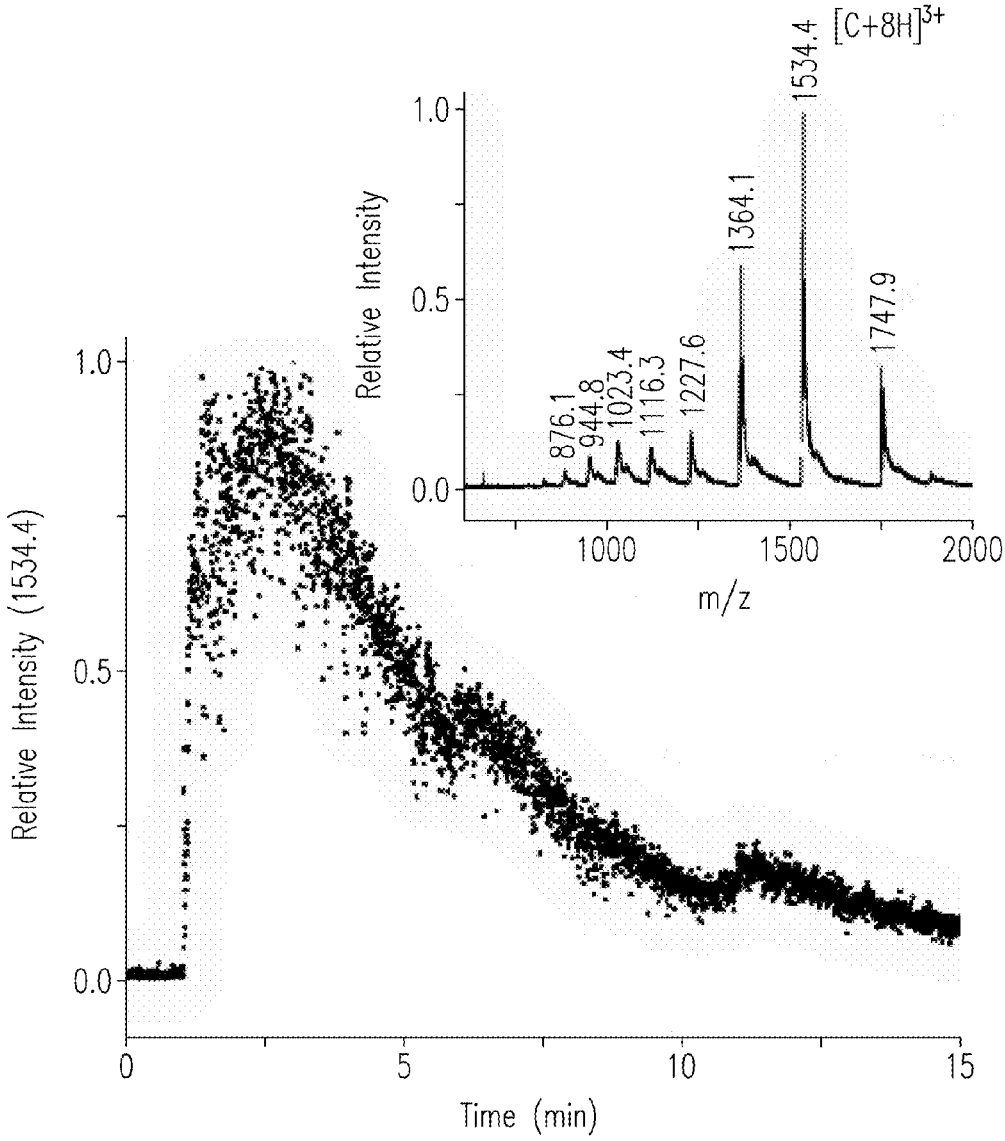
FIG. 7 shows an analysis of cytochrome-C collected using an embodiment of the invention.

FIG. 7 shows an exemplary analysis with the invention of an analyte film containing 3 pmol (38 ng) cytochrome-C (bovine heart) placed on an Omnislide® substrate (Prosolia Inc., Indianapolis, Ind., USA). The analysis was conducted over an extended period of 15 minutes. In the figure, the major plot shows the SIC of the +8 charge state of the protein (i.e., $[C+8H]^{8+}$) for the mass peak positioned at an (m/z) value of 1534.4. The inset plot shows the mass spectrum averaged over the entire SIC chromatographic peak. The protein signal showed an increase in the first 1.5 minutes, which decayed to half maximum at 4 minutes. The slower rise and decay times with respect to rhodamine and reserpine are attributed to different rates of analyte dissolution into the solvent in the contact (sampling) area. Intensity fluctuations at 6 minutes and 11 minutes are attributed to changes in the contact area between the droplet and the surface from nonlinearities in the supply pumping rate or bubbles in the solvent line.

The following example provides a further understanding of the invention in its various aspects.

Example 1

Sample Preparation for Analyses of Rhodamine, Reserpine, and Cytochrome-C

Experimental. Samples and Reagents. Water, methanol (both HPLC grade), glacial acetic acid, cytochrome-C (bovine heart) and reserpine (all from Fischer Scientific, Inc., Waltham, Mass., USA) were used in experiments in testing of the invention. Cytochrome-C was dissolved in a mixture of water, methanol, and acetic acid (50:48:2) to a concentration of 19 ng/μL. Reserpine was dissolved in a mixture of methanol and acetic acid (10:1) to a concentration of 0.7 ng/μL. A 2 μL aliquot of cytochrome-C solution and a 1 μL aliquot of reserpine solution were pipetted onto an Omnislide® hydrophobic array (Prosolia, Inc., Indianapolis, Ind., USA) and allowed to dry before analysis. A film of rhodamine dye from a red Sharpie® permanent marker (Sanford) was created on a plain microscope slide (Fischer Scientific) by coloring the slide and allowing the deposited rhodamine and reserpine dye films to dry. Methanol (rhodamine and reserpine) or methanol and water (50:50, cytochrome-C) were used as spray solvents. Solvent flow rate was matched to the self-aspiration rate of the collection (probe) capillary, which was typically about 0.6 μL/min.

Apparatus. Samples were analyzed using a mass spectrometer (e.g., a Finnigan LTQ/Orbitrap mass spectrometer, Thermo Electron, Bremen, Germany) equipped with a detachable DESI-MS source (Prosolia Inc., Indianapolis, Ind., USA) modified according to the invention for experiments as follows. Capillaries of fused Silica (50 μm ID, 184 μm OD, Polymicro Technologies, L.L.C., Phoenix) were used to create a supply capillary and a collection (probe) capillary. Collection (probe) capillary was mounted in a 1/16-inch outer-diameter (O.D.) capillary made from PEEK tubing (Upchurch Scientific, Oak Harbor, USA) and affixed to an extended ion transfer tube (Prosolia, Inc., Indianapolis, USA) using a custom PEEK holder. Images of the droplet imprints left in the analyte films were taken using a Nikon Eclipse LV150 microscope with a 20×/0.45 final objective and NIS-Elements Imaging Software (Nikon Instruments, Inc., Tokyo, Japan).

Conclusions

A new ambient desorption ionization apparatus and process have been detailed. Desorption and ionization mechanisms have been engineered to allow controllable, stable, and reliable operation while minimizing the number of relevant adjustable parameters. For example, mechanisms for analyte desorption and ionization do not require momentum transfer from incoming spray droplets as in conventional surface sampling mass spectrometry techniques, thus eliminating the need for a nebulizing gas. Solvent containing the analyte desorbed from the sampling surface is self-aspirated, ionized, and emitted as a focused spray, which eliminates the dependence of sampling efficiency on the dynamics and velocity distribution of secondary droplets. Size of the contact (sampling) area on the sampling surface can be directly varied by manipulating solvent flow rates or changing the point sizes (diameters) of the supply and collection capillaries, which can provide enhanced spatial resolution in imaging applications.

While preferred embodiments of the present invention have been shown and described, it will be apparent to those of ordinary skill in the art that many changes and modifications may be made without departing from the invention in its true scope and broader aspects. The appended claims are therefore intended to cover all such changes and modifications as fall within the spirit and scope of the invention.

What is claimed is:

1. An apparatus for delivery of an analyte to a mass spectrometer, said apparatus characterized by:

a supply capillary that delivers solvent at a preselected flow rate to a sampling surface having an analyte disposed thereon; and a collection capillary having;

a collection end that aspirates solvent containing analyte desorbed from said surface; and an emission end that emits a focused spray of analyte ions at a preselected potential into an inlet of a mass analyzer positioned a preselected distance therefrom.

2. The apparatus of claim 1, wherein the solvent is in continuous fluid contact with the supply capillary and the sampling surface.

3. The apparatus of claim 1, wherein transfer of solvent from the supply capillary to the sampling surface does not involve nebulization or spraying.

4. The apparatus of claim 1, wherein the contact area between the solvent and the sampling surface has a diameter in the range between about 50 μm and about 6000 μm.

5. The apparatus of claim 4, wherein the flow rate of the supply capillary maintains the preselected size of the contact area on the sampling surface.

6. The apparatus of claim 5, wherein the flow rate of the supply capillary is between about 0.1 μL/min and about 0.2 μL/min.

7. The apparatus of claim 1, wherein the collection end of the collection capillary has a point size less than or equal to about 360 μm.

8. The apparatus of claim 1, wherein the emission end of the collection capillary has a point size less than or equal to about 360 μm.

9. The apparatus of claim 1, wherein the emission end of the collection capillary is positioned a distance from the inlet of the mass analyzer of less than or equal to about 15 mm.

10. The apparatus of claim 1, wherein the preselected potential is in the range less than or equal to about 8,000 volts.

11. The apparatus of claim 10, wherein the solvent from the supply capillary is in electrical contact with two terminals establishing a liquid circuit that defines the spray voltage at the preselected potential.

12. The apparatus of claim 11, wherein the two terminals are the sampling surface and the inlet of the mass analyzer, respectively.

13. The apparatus of claim 11, wherein the two terminals are the supply capillary and the net of the mass analyzer, respectively.

14. The apparatus of claim 1, wherein the sampling surface includes a three-dimensional surface.

15. The apparatus of claim 1, further including an enclosure that is evacuated or pressurized.

16. A process for delivery of an analyte to a mass spectrometer, the process comprising the steps of:

delivering a preselected quantity of a solvent to a sampling surface having an analyte disposed thereon;

self-aspirating a preselected portion of the solvent that contains analyte desorbed from the sampling surface at a preselected potential; and emitting a focused spray of analyte ions at a preselected potential into an inlet of a mass analyzer positioned a preselected distance therefrom.

17. The process of claim 16, wherein the step of delivering includes a quantity of solvent below about 300 μm.

18. The process of claim 16, wherein the step of delivering is performed in the absence of a nebulizing gas.

19. The process of claim 16, wherein the step of delivering includes a flow rate between about 0.1 uL/min and about 0.4 uL/min.

20. The process of claim 16, wherein the step of delivering includes delivering the solvent by pneumatic flow to the sampling surface.

21. The process of claim 16, wherein the emitting step includes emitting analyte-containing solvent in an electric field as a focused spray of self-aspirated analyte ions.

22. The process of claim 21, wherein the electric field includes a potential difference that is biased positively or negatively to generate positive or negatively charged analyte ions, respectively, 23. The process of claim 16, wherein the process is conducted at atmospheric pressure.

24. The process of claim 16, wherein the process is conducted at other than atmospheric pressure.

25. The process of claim 16, wherein the limit of detection or sensitivity is at least one order of magnitude better than a limit of detection or sensitivity for a conventional desorption electrospray ionization method.

26. The process of claim 16, wherein the sampling surface includes a three-dimensional surface.

27. A process for delivery of an analyte to a mass spectrometer instrument, the process comprising the steps of:

supplying a quantity of a solvent to a sampling surface having an analyte disposed thereon at the junction between a supply capillary and a collection capillary such that the solvent is in continuous fluid contact with the supply capillary and the sampling surface;

aspirating a preselected fraction of the solvent containing analyte desorbed from the sampling surface into a collection end of a collection capillary; and emitting a focused spray of analyte ions at a preselected potential from an emission end of the collection capillary into an inlet of a mass analyzer positioned a preselected distance therefrom.

28. The process of claim 27, wherein flow of analyte-containing solvent in the collection capillary is a self-aspirating fluid flow.

29. The process of claim 27, wherein the aspirating step includes contacting the analyte-containing solvent with the collection capillary at the collection end and immersing same therein.

30. The process of claim 29, wherein the contacting includes a contact time between the collection capillary and the analyte-containing solvent that is below about 2 hours.

31. The process of claim 29, wherein the contacting includes a contact time between the collection capillary and the analyte-containing solvent that is below about 1 second.

* * * * *

UNITED STATES PATENT AND TRADEMARK OFFICE

CERTIFICATE OF CORRECTION

PATENT NO. : 8,097,845 B2
APPLICATION NO. : 12/722257
DATED : January 17, 2012
INVENTOR(S) : Patrick J. Roach et al.

It is certified that error appears in the above-identified patent and that said Letters Patent is hereby corrected as shown below:

Col. 11, line 36: replace “net” with “inlet”

Signed and Sealed this
Sixth Day of March, 2012

David J. Kappos

David J. Kappos
*Director of the United States Patent and Trademark Office*